US006174204B1

(12) United States Patent
Boivin

(10) Patent No.: US 6,174,204 B1
(45) **Date of Patent: *Jan. 16, 2001**

(54) JUNCTION BOX WITH IMPROVED FUSE ACCESS

(75) Inventor: J. Ivan Boivin, Howell, MI (US)

(73) Assignee: Lear Automotive Dearborn, Inc., Southfield, MI (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/137,189

(22) Filed: Aug. 20, 1998

(51) Int. Cl.[7] ..... H01R 13/68
(52) U.S. Cl. ..... 439/621
(58) Field of Search ..... 439/621, 622, 439/76.2; 29/278, 270; 174/52.1; 361/641

(56) References Cited

U.S. PATENT DOCUMENTS

| | | | | |
|---|---|---|---|---|
| 4,221,455 | | 9/1980 | Cairns et al. . | |
| 5,215,479 | | 6/1993 | Araki et al. . | |
| 5,285,011 | * | 2/1994 | Shimochi | 174/52.1 |
| 5,662,496 | * | 9/1997 | Kanamori | 439/621 |

FOREIGN PATENT DOCUMENTS

| | | |
|---|---|---|
| 41 25 394 A1 | 2/1992 | (DE) . |
| 41 30 222 A1 | 3/1992 | (DE) . |
| 2019133 | 10/1979 | (GB) . |

OTHER PUBLICATIONS

International Search Report, Dec. 6, 1999.

* cited by examiner

*Primary Examiner*—Paula Bradley
*Assistant Examiner*—Alexander Gilman
(74) *Attorney, Agent, or Firm*—Brooks & Kushman P.C.

(57) ABSTRACT

A fuse holding structure includes a housing having several fuse sockets recessed therein. A wall extends upwardly from the housing adjacent the fuse sockets and includes recesses adapted to partially surround each fuse socket without fully surrounding each fuse socket. The wall does not fully surround the fuse sockets in order to permit a user to manually grasp the fuses and remove the fuses from the sockets. The wall extends upwardly from the housing a distance sufficient to protect the fuses from damage.

13 Claims, 3 Drawing Sheets

JUNCTION BOX WITH IMPROVED FUSE ACCESS

BACKGROUND OF THE INVENTION

This invention relates to a fuse holding structure for retaining and protecting fuses while permitting a user to manually access the fuses.

Fuse holding structures, such as junction boxes, typically include several rows of fuse sockets adapted to receive fuses. The fuse sockets are generally recessed into a top surface of the junction box and at a depth sufficient to permit the fuses to be fully received therein. Thus, the fuse sockets are defined by walls which extend upwardly at a height equal to, or greater than, the fuses. Because the fuses are fully recessed within the fuse sockets, the walls surrounding each socket protect the fuses from damage in the event a foreign object strikes the top surface of the junction box.

The sockets have a diameter only slightly larger than the fuses to enable the sockets to securely retain each fuse. Unfortunately, because the fuses are closely surrounded by the sockets, it is very difficult for users to manually grasp the fuses with their fingers to remove the fuses from the junction box. This is particularly true for the mini-fuses used in many automotive applications. Thus, removing the fuses often requires pliers or another removal tool which makes the removal process unnecessarily complex.

SUMMARY OF THE INVENTION

The present invention is directed to a fuse holding structure including a housing having at least one fuse socket recessed within the housing. A wall extends upwardly from the housing adjacent the fuse socket and partially surrounds the fuse socket without fully surrounding the fuse socket. In this manner, the wall protects the fuse from damage while providing access for a user to manually grasp the fuse.

In other features of this invention, the wall is integrally molded with the housing and extends upwardly from the housing at least as far as the height of the fuse. Further, the wall can extend between first and second rows of fuse sockets on the housing and include recesses on opposing sides of the wall which are adapted to partially surround fuses disposed in the first and second row of fuse sockets.

In another feature of the present invention, a method is provided for manufacturing a fuse holding structure including providing a housing and forming at least one fuse socket recessed within the housing. The method also includes forming a wall extending upwardly from the housing adjacent the fuse socket to partially surround without fully surrounding the fuse socket. In this manner, the fuse holding structure can protect the fuse from damage while providing access for a user to manually grasp the fuse.

In another feature of this invention, the fuse holding structure comprises a junction box adapted to hold several fuses.

These and other features of the present invention can be best understood from the following specification and drawings. The following is a brief description of the drawings in this application.

DETAILED DESCRIPTION OF A PREFERRED EMBODIMENT

Figure 1:
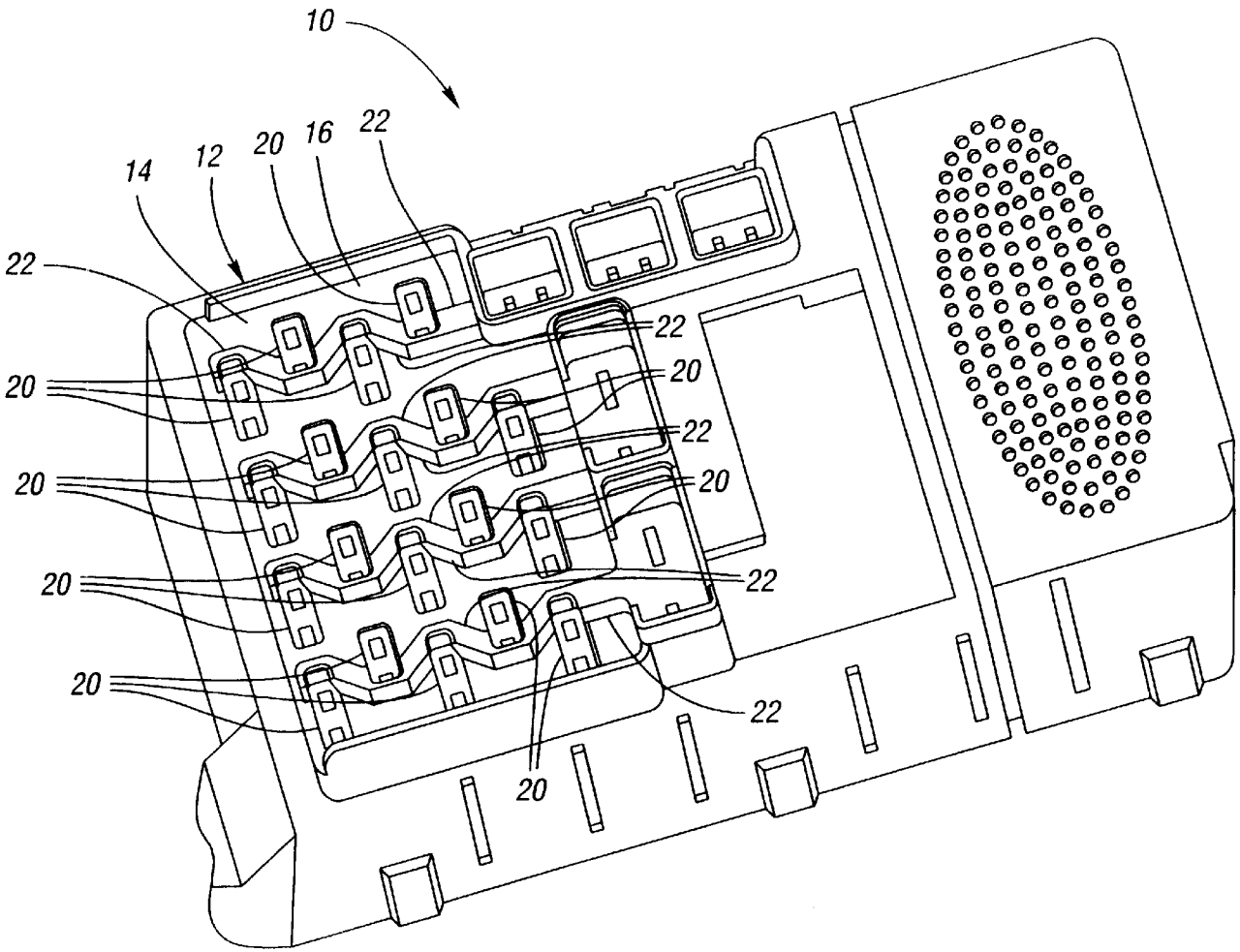
FIG. 1 is a perspective view of the junction box of the present invention illustrating the fuse sockets and the walls which partially surround the fuse sockets.

The present invention is generally shown at 10 in FIG. 1 and includes a junction box 12 having a housing 14 including a top surface 16. The junction box 12 includes several fuse sockets 20 disposed within the top surface 16 which form recessed cavities adapted to receive fuses. Several walls 22 extend upwardly from the top surface 16 of the housing 14 adjacent the fuse sockets 20 and partially surround each fuse socket 20 without fully surrounding each fuse socket 20. The junction box 12 is preferably a molded plastic member although it is not essential that the junction box 12 be molded or manufactured from a particular material in order to practice the invention. The walls 22 are preferably integrally molded with the housing 14 of the junction box 12.

Figure 2:
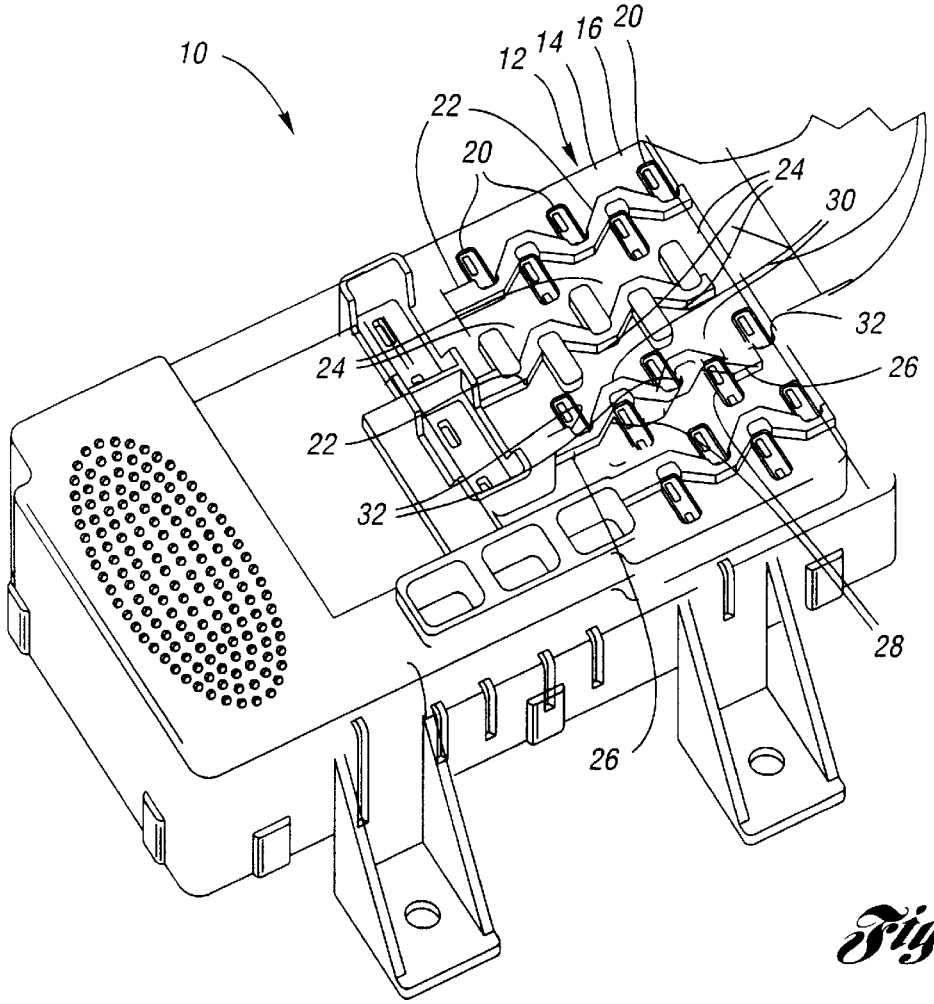
FIG. 2 is a second perspective view of the junction box of the present invention taken from an opposite side than shown in FIG. 1.

FIG. 2 illustrates the junction box 12 from an opposite side than shown in FIG. 1. In FIG. 2, fuses 24 have been inserted within several of the fuse sockets 20. Because the fuse sockets 20 are not deep enough to fully receive each fuse 24, the fuses 24 extend upwardly from the top surface 16 of the housing 14 by a height. The fuses 24 shown in FIG. 2 are mini-fuses of the type used in automotive applications, as would be understood by a person of ordinary skill in this art.

To protect the fuses 24, the walls 22 partially surround each fuse socket 20 and, consequently, each fuse 24. The walls 22 extend upwardly from the top surface 16 of the housing 14 at a height at least equal to the distance that each fuse 24 extends upwardly from the top surface 16. Preferably, the walls 22 extend a few millimeters above the height of each fuse 24 to provide a barrier against impact. Without the walls 22, the relatively fragile fuses 24 could be easily damaged if another object contacted the junction box 12 or if the junction box 12 was dropped.

As shown in FIG. 2, the fuse sockets 20 are arranged in vertical and horizontal rows. The sockets 20 in each horizontal row are vertically offset from, but partially overlapping, the sockets 20 in the adjacent horizontal rows. Similarly, the sockets 20 in each vertical row are horizontally offset from, but partially overlapping, the sockets 20 in the adjacent vertical rows. A wall 22 extends between each pair of horizontal rows of fuse sockets 20 in a generally sinuous pattern. Specifically, each wall 22 includes a front face 26 forming several recesses 28 adapted to partially surround the fuse sockets 20 in the first row of each pair of horizontal rows. Each wall 22 also includes a back face 30 having several recesses 32 adapted to partially surround the fuse sockets 20 in the second row of each pair of horizontal rows. The recesses 28,32 permit access to the fuses 24 while protecting adjacent fuses from contact when a particular fuse 24 is being removed or inserted.

Figure 3:
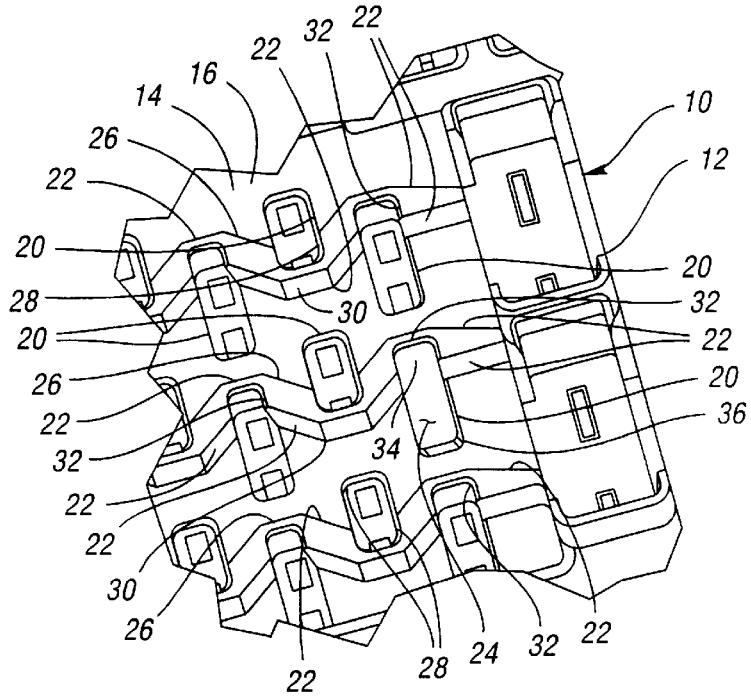
FIG. 3 is a close-up view of a fuse inserted within a fuse socket.

FIG. 3 illustrates a close-up view of the junction box 12 illustrating a fuse 24 positioned in a fuse socket 20. The fuse 24 includes a first side 34 generally located within the recess 28 in the wall 22 and a second side 36 which is freely exposed to permit a user to grasp the fuse 24.

Figure 4:
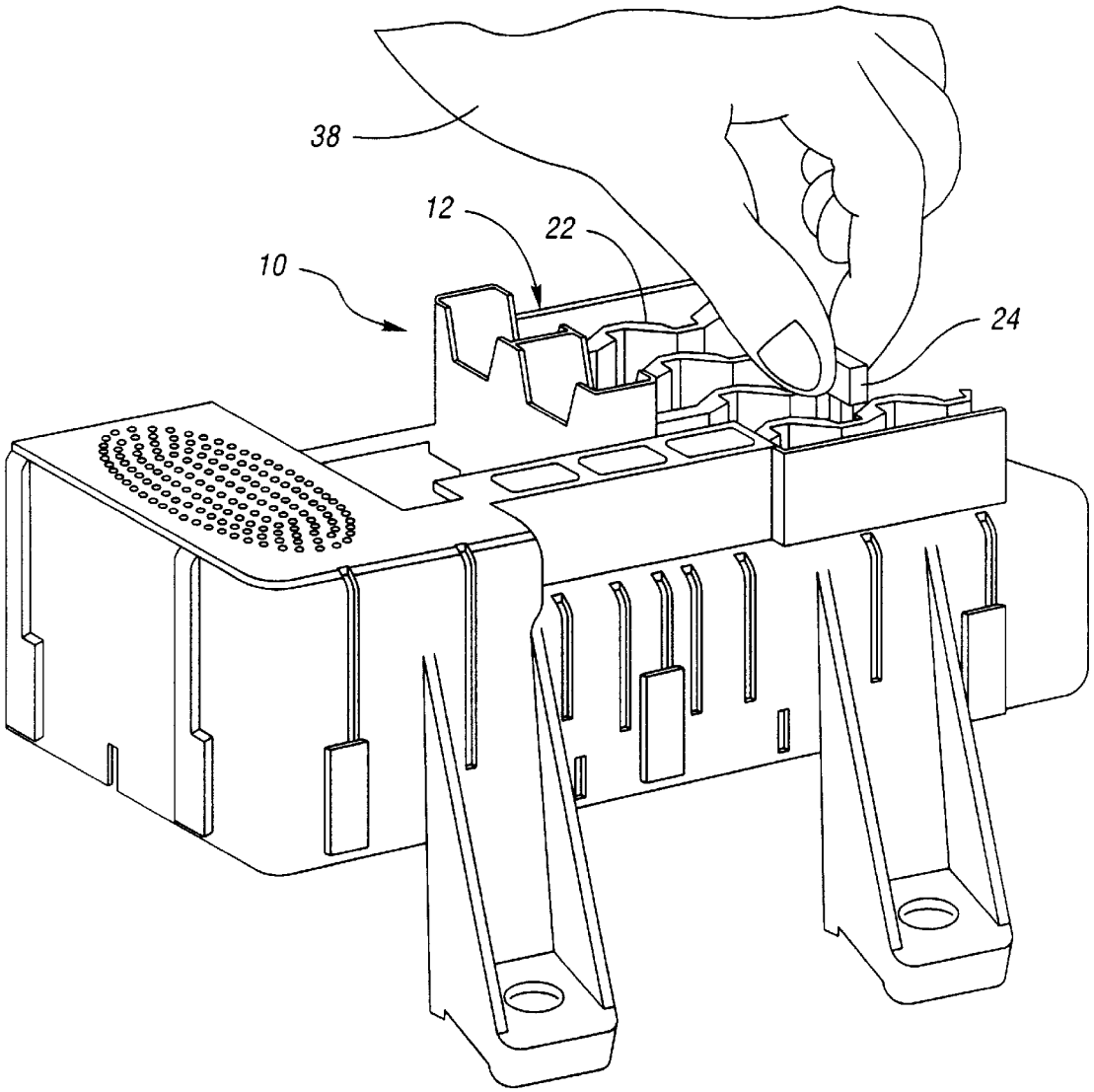
FIG. 4 is a third perspective view of the junction box illustrating a fuse being manually removed from a fuse socket.

As shown in FIG. 4, a user 38 can manually grasp the fuse 24 with his or her fingers to remove the fuse 24 from the fuse socket 20. Thus, special tools are not required to remove the fuses 24 from the junction box 12 which simplifies the procedure for removing and changing fuses 24.

The present invention also provides a method of manufacturing a fuse holding structure such as a junction box 12. The method involves molding a housing 14 having several fuse sockets 20 recessed within a top surface 16 of the housing 14. A wall 22 is integrally molded with the housing 14 to extend upwardly from the top surface 16 of the housing 14 adjacent each fuse socket 20. The wall 22 is also formed to partially surround each fuse socket 20 without fully surrounding each fuse socket 20. The junction box 12 is otherwise molded to form the structure described above and shown in FIGS. 1–4.

A preferred embodiment of this invention has been disclosed. However, a worker of ordinary skill in the art would recognize that certain modifications come within the scope of this invention. For that reason, the following claims should be studied to determine the true scope and content of the invention.

What is claimed is:

1. A fuse holding structure comprising:

a housing;

a first and a second row of fuse sockets recessed within said housing;

a wall sinuously extending from the housing and positioned adjacent an end of each of the recessed fuse sockets so as to partially surround only one end of each fuse socket, wherein an opposite end of each recessed fuse socket is left unsurrounded, thereby protecting the fuse from damage while providing access for a user to manually grasp the fuse;

said wall including a front face and a rear face;

said wall extending between said first and said second row of fuse sockets;

said front face of said wall including a plurality of recesses adapted to partially surround fuses disposed in said first row of said fuse sockets; and said rear face of said wall including a plurality of recesses adapted to partially surround fuses disposed in said second row of said fuse sockets.

2. The fuse holding structure of claim 1 wherein said housing comprises a junction box.

3. The fuse holding structure of claim 1 wherein said wall is integrally molded with said housing.

4. The fuse holding structure of claim 1 further comprising a plurality of walls extending upwardly from said housing adjacent said fuse socket wherein said walls cooperate to partially surround said fuse socket without fully surrounding said fuse socket.

5. The fuse holding structure of claim 1 further comprising:

a third and a fourth row of fuse sockets recessed within said housing;

a second wall extending upwardly from housing between said third and fourth row of fuse sockets said second wall including a front face and a rear face;

said second wall extending between said third and said fourth row of fuse sockets;

said front face of said second wall including a plurality of recesses adapted to partially surround fuses disposed in said third row of said fuse sockets; and said rear face of said second wall including a plurality of recesses adapted to partially surround fuses disposed in said fourth row of said fuse sockets.

6. The fuse holding structure of claim 1 further comprising:

a fuse disposed within said fuse socket and extending upwardly from said housing by a height wherein said wall extends upwardly from said housing at least as far as said height of said fuse to thereby protect said fuse from damage.

7. The fuse holding structure of claim 6 wherein said wall extends upwardly from said housing a distance greater than said height of said fuse.

8. A method of manufacturing a fuse holding structure comprising:

providing a housing;

forming a first and second row of fuse sockets each defining a recessed cavity having a cavity bottom within the housing;

forming a wall extending in a sinuous pattern from the housing between the first and second row of fuse sockets;

forming the wall to partially surround the fuse sockets without fully surrounding the fuse sockets to thereby protect the fuses from damage while providing access for a user to manually grasp the fuse;

providing a plurality of recesses in a front face of the wall which are adapted to partially surround the fuses disposed in the first row of fuse sockets; and providing a plurality of recesses in a rear face of the wall which are adapted to partially surround the fuses disposed in the second row of fuse sockets.

9. The method of claim 8 further comprising integrally molding the wall with the housing.

10. The method of claim 8 further comprising forming a plurality of walls extending upwardly from the housing adjacent the fuse socket wherein the walls cooperate to partially surround the fuse socket without fully surrounding the fuse socket.

11. The method of claim 8 wherein a fuse is disposed in the fuse socket and extends upwardly from the top surface by a height, said method further comprising forming the wall to extend upwardly from the top surface at least as far as the height of the fuse to thereby protect the fuse from damage.

12. A junction box adapted to hold a plurality of fuses, said junction box comprising:

a housing including a top surface;

a first and a second row of fuse sockets defining recessed cavities having cavity bottoms within said top surface of said housing:

a wall extending sinuously between the first and the second rows of the fuse sockets and from the housing between said first row and said second row of fuse sockets;

said wall including a front face and a rear face;

said front face of said wall including a plurality of recesses, each of the recesses being contiguous with an end of a respective recessed fuse socket in the first row so as to partially surround one end of the respective fuses disposed in the sockets while leaving an opposing end of each respective fuse unsurrounded for unrestricted user access to the fuse; and said rear face of said wall including a plurality of recesses, each of the recesses being contiguous with an end of a respective recessed fuse socket in the second row so as to partially surround one end of the respective fuses disposed in the sockets while leaving an opposing end of each respective fuse unsurrounded for unrestricted user access to the fuse.

13. The junction box of claim 12 further comprising:

a plurality of fuses disposed within said fuse sockets and extending upwardly from said top surface by a height wherein said wall is integrally molded with said housing and extends upwardly from said top surface a distance greater than said height of said fuses.

* * * * *